US006065553A

United States Patent [19]

Taylor

[11] Patent Number: 6,065,553

[45] Date of Patent: May 23, 2000

[54] SPLIT BLADE ROTARY DRAG TYPE DRILL BITS

[75] Inventor: Steven Taylor, Cheltenham, United Kingdom

[73] Assignee: Camco International (UK) Limited, Stonehouse, United Kingdom

[21] Appl. No.: 09/047,916

[22] Filed: Mar. 25, 1998

[30] Foreign Application Priority Data

Aug. 20, 1997 [GB] United Kingdom ..... 9717505

[51] Int. Cl.[7] ..... E21B 10/36

[52] U.S. Cl. ..... 175/429; 175/428; 175/431

[58] Field of Search ..... 175/426, 421, 175/398, 405.1, 393, 428, 431, 429

[56] References Cited

U.S. PATENT DOCUMENTS

| | | | |
|---|---|---|---|
| 4,246,977 | 1/1981 | Allen | 175/428 |
| 4,714,120 | 12/1987 | King | 175/329 |
| 4,830,123 | 5/1989 | Daly et al. | 175/431 |
| 4,889,017 | 12/1989 | Fuller et al. | 175/428 X |
| 4,907,662 | 3/1990 | Deane et al. | 175/431 |
| 5,238,075 | 8/1993 | Keith et al. | 175/431 |
| 5,361,859 | 11/1994 | Tibbitts | 175/286 |
| 5,582,261 | 12/1996 | Keith et al. | 175/431 |
| 5,699,868 | 12/1997 | Caraway et al. | 175/339 |
| 5,816,346 | 10/1998 | Beaton | 175/431 |
| 5,829,539 | 11/1998 | Newton et al. | 175/393 |
| 5,888,619 | 3/1999 | Griffin | 428/172 |

OTHER PUBLICATIONS

1998 Hughes Tool Company Brochure—Hughes Blue Chip Bits—B15M Polycrystalline Diamond Bit.

1998 Hughes Tool Company Brochure—Hughes Blue Chip Bits—B17M Polycrystalline Diamond Bit.

1998 Hughes Tool Company Brochure—Hughes Blue Chip Bits—B33M Polycrystalline Diamond Bit.

1998 Hughes Tool Company Brochure—Hughes Blue Chip Bits—B35M Polycrystalline Diamond Bit.

*Primary Examiner*—Eileen Dunn Lillis
*Assistant Examiner*—Jong-Suk Lee
*Attorney, Agent, or Firm*—Jeffery E. Daly

[57] ABSTRACT

A drag-type drill bit for drilling holes in subsurface formations comprises a bit body having an end face and a shank for connection to a drill string, a number of blades upstanding from the end face of the bit body and extending outwardly away from the central axis of rotation of the bit, a number of cutters mounted on each blade, and a number of nozzles in the bit body for delivering drilling fluid for cooling and cleaning the cutters. The blades include primary blades which, at their outer ends, are spaced apart around aperipheral gauge portion of the bit, and secondary blades which are spaced circumferentially between adjacent primary blades, each secondary blade having an outer end which terminates at a location inwardly of the gauge portion of the bit. Each primary blade and associated secondary blade may be equivalent, in terms of their combined contribution to the cutting profile, to a single blade which extends continuously from the centre of the bit body to the gauge, but the separation of the blades facilitates the flow of drilling fluid over and between the blades. Also, the increased number of blades may enhance the stability of the drill bit and reduce vibration.

10 Claims, 2 Drawing Sheets

SPLIT BLADE ROTARY DRAG TYPE DRILL BITS

BACKGROUND OF THE INVENTION

1. Field of the Invention

The invention relates to rotary drag-type drill bits, for use in drilling or coring holes in subsurface formations, and of the kind comprising a bit body having an end face and a shank for connection to a drill string, a plurality of blades upstanding from the end face of the bit body and extending outwardly away from the central axis of rotation of the bit, a plurality of cutters mounted on each blade, and a plurality of nozzles in the bit body for delivering drilling fluid to the end face thereof for cooling and cleaning the cutters. Each cutter may include a preform cutting element of the kind comprising a front facing table of superhard material bonded to a less hard substrate. The cutting element may be mounted on a carrier, also of a material which is less hard than the superhard material, which is mounted on the body of the drill bit, for example, is secured within a socket on the bit body. Alternatively, the cutting element may be mounted directly on the bit body, for example the substrate may be of sufficient axial length that it may itself be secured within a socket on the bit body.

2. Description of Related Art

In drag-type drill bits of this kind the bit body may be machined from metal, usually steel, and sockets to receive the carriers or the cutting elements themselves are machined in the bit body. Alternatively, the bit body may be moulded from tungsten carbide matrix material using a powder metallurgy process.

In prior art drag-type drill bits where the cutters are mounted on blades extending outwardly away from the central axis of rotation of the bit, it is usual for each blade, at its outer end, to join a respective kicker which, in use, engages the surrounding wall of the borehole being drilled. The kickers are spaced apart around a peripheral gauge portion of the bit so as to define between the kickers junk slots through which drilling fluid flows from the end face of the bit to the annulus between the drill string and the walls of the borehole. Since it is desirable for the cutters on the blades to define a cutting profile which extends over substantially the whole of the bottom surface of the borehole, it is necessary for at least some of the blades to extend substantially all the way from the central of the end face of the bit outwardly to the gauge of the bit. However, such arrangement inhibits the flow of drilling fluid across the blades in the circumferential direction. Also, if the total number of blades is reduced to improve cutting effectiveness, the stability of the bit may be compromised. The present invention therefore sets out to provide a novel arrangement of blades on a drag-type drill bit whereby these disadvantages of prior art constructions may be reduced or overcome.

SUMMARY OF THE INVENTION

According to the invention there is provided a drag-type drill bit for drilling holes in subsurface formations comprising a bit body having an end face and a shank for connection to a drill string, a plurality of blades upstanding from the end face of the bit body and extending outwardly away from the central axis of rotation of the bit, a plurality of cutters mounted on each blade, and a plurality of nozzles in the bit body for delivering drilling fluid to the end face thereof for cooling and cleaning the cutters, said blades including a plurality of primary blades which, at their outer ends, are spaced apart around a peripheral gauge portion of the bit, and a plurality of secondary blades spaced circumferentially between adjacent primary blades, each secondary blade having an outer end which terminates at a location inwardly of the gauge portion of the bit.

The outer ends of the primary blades may join respective kickers which, in use, engage the surrounding wall of the borehole being drilled. There may be defined between the kickers junk slots through which drilling fluid flows from the end face of the bit.

Thus, each primary blade and an associated secondary blade, although spaced circumferentially apart, may be equivalent, in terms of their combined contribution to the cutting profile, to a single blade which extends continuously from the center of the bit body to the gauge, but the separation of the blades facilitates the flow of drilling fluid over and between the blades. Also, cuttings washed from a secondary blade by the flow of drilling fluid are swept to a different region of the associated junk slot than the cuttings from the associated primary blade, thus facilitating a flow of cuttings up through the junk slot. Also, the increased number of blades may enhance the stability of the drill bit and reduce vibration.

Preferably the outer end of each secondary blade terminates at the outer periphery of the end face of the bit body.

The number of secondary blades may equal the number of primary blades, secondary blades alternating with primary blades around the central axis of rotation of the bit body.

Preferably the cutters on the blades are located at different distances from the central axis of rotation of the bit body so as to define a substantially continuous cutting profile which extends over substantially the whole of the bottom surface of the borehole being drilled.

In any of the above arrangements according to the invention, each cutting element may be a preform cutting element comprising a front facing table of superhard material bonded to a less hard substrate.

The cutting element may be substantially cylindrical, the substrate being of sufficient axial length to be received and secured within a cylindrical socket in the bit body.

Each cutting element may be of generally circular cross-section and may have a substantially straight cutting edge formed by a substantially flat bevel in the facing table and substrate which is inclined to the front surface of the facing table as it extends rearwardly therefrom.

DETAILED DESCRIPTION OF THE PREFERRED EMBODIMENTS

Figure 1:
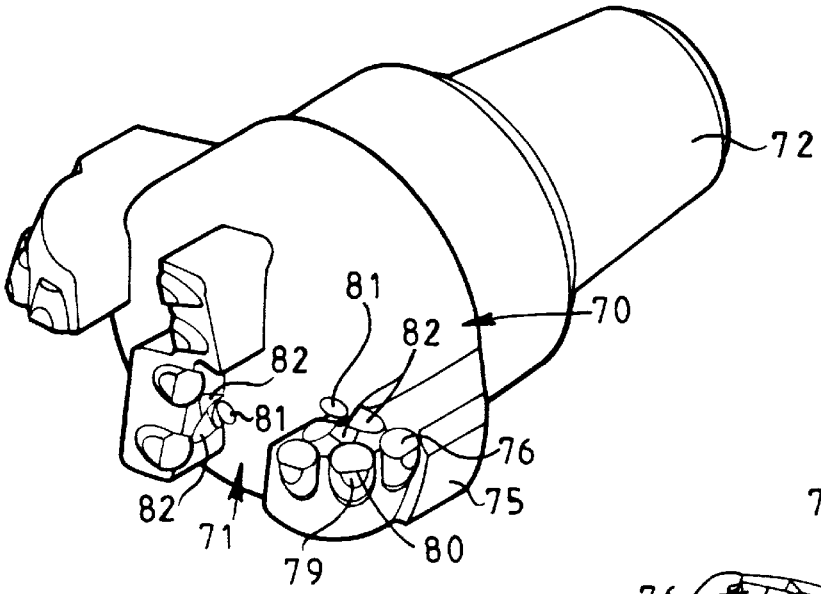
FIG. 1 is a diagrammatic perspective view of a drag-type drill bit incorporating the invention.

Referring to FIGS. 1–4 the drag-type drill bit comprises a bit body 70 having an end face 71 and formed with a tapered threaded pin 72 for connecting the drill bit to a drill string in known manner. The end face 71 of the bit body is formed with four upstanding blade 73 and 74 which extend outwardly away from the central longitudinal axis of rotation of the drill bit. The inner two blades 74 are joined at the center of the bit whereas the outer two blades 73 are widely separated and are connected to respective kickers 75 which engage the walls of the borehole being drilled, in use, so as to stabilise the bit within the borehole. Each inner blade 74 is formed with two spaced cutters 76 and each outer blade 73 is formed with three spaced cutters 76.

Each cutter 76 is generally cylindrical and is a preform cutter comprising a front facing table 77 (see FIG. 4) of polycrystalline diamond bonded to a cylindrical substrate 78 of cemented tungsten carbide. The substrate is received and secured in a socket in the respective blade 73 or 74.

Each cutter 76 is formed with an inclined bevel 79 which is inclined to the front face of the facing table 77 so as to form a generally straight cutting edge 80.

The purpose of the inclined bevel 79 on the cutter 76 is to limit the depth of cut of the cutters. This feature reduces the rate of penetration of the drill bit and hence reduces the volume of cuttings (chips or shavings) produced with respect to time and hydraulic flow. This therefore facilitates the removal of the cuttings as they are formed.

The cutters 76 are arranged at different distances from the central axis of rotation of the drill bit so that, as the bit rotates, the cutters between them sweep over the whole of the bottom surface of the borehole so as to define a substantially continuous cutting profile.

On the leading side of each blade 73 and 74, there is mounted in the leading surface 71 of the drill bit a nozzle 81 for delivering drilling fluid to the surface of the drill bit. As is well known, drilling fluid under pressure is delivered downhole through the drill string and through a central passage in the bit body and subsidiary passages leading to the nozzles 81. The purpose of the drilling fluid is to cool and clean the cutters and to carry back to the surface cuttings or chips removed from the formation by the cutters. Drilling fluid emerging from the nozzles normally flows outwardly across the leading surface of the bit body so as to be returned to the surface through the annulus between the drill string and the surrounding formation of the borehole.

In a common prior art arrangement the cutters on the blades face into channels defined between the blades, which cutters extend outwardly from the central axis of the drill bit to junk slots at the periphery. The nozzles are located and orientated to cause fluid to flow outwardly along these channels and, in so doing, to wash over the cutters so as to clean and cool them. According to the present invention, however, means are provided for directing the flow of drilling fluid more specifically on to individual cutters.

Figure 4:
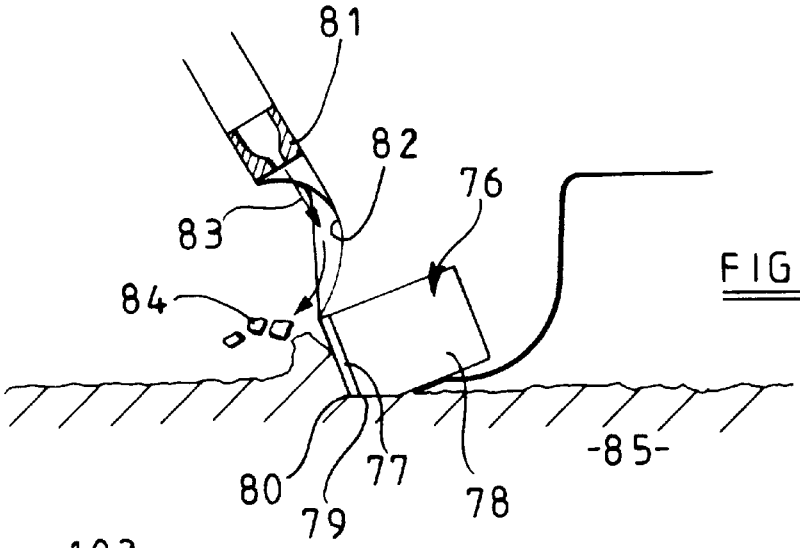
FIG. 4 is a diagrammatic section through a cutting structure of the drill bit shown in FIGS. 1–3.

As best seen in FIG. 1 and FIG. 4, each nozzle 81 is located adjacent the downstream ends of two or three grooves 82 which are formed in the leading surface of the associated blade 73 or 74 and are orientated to direct fluid from the nozzle 81 to the respective cutters 76 on the blade.

As best seen in FIG. 4, fluid discharged from the nozzle 81 is directed along each of the grooves 82, as indicated by the arrows 83, so as to impinge on a cutting 84 being raised from the formation 85 by the cutter 76. The hydraulic pressure of the jet of fluid serves to break up the cutting 84 into smaller chips so that it is more easily detached from the surface of the formation and entrained in the flow of drilling fluid.

The arrangement of FIGS. 1–4 is particularly advantageous in drill bits for drilling soft and sticky formations such as plastic shales. The provision of the grooves 82 concentrates the hydraulic energy in the drilling fluid emerging from each nozzle directly on to the individual cutters. The grooves split up the flow from each nozzle and form discrete jets of fluid to impact on the cuttings of formation being removed by the cutter.

Figure 2:
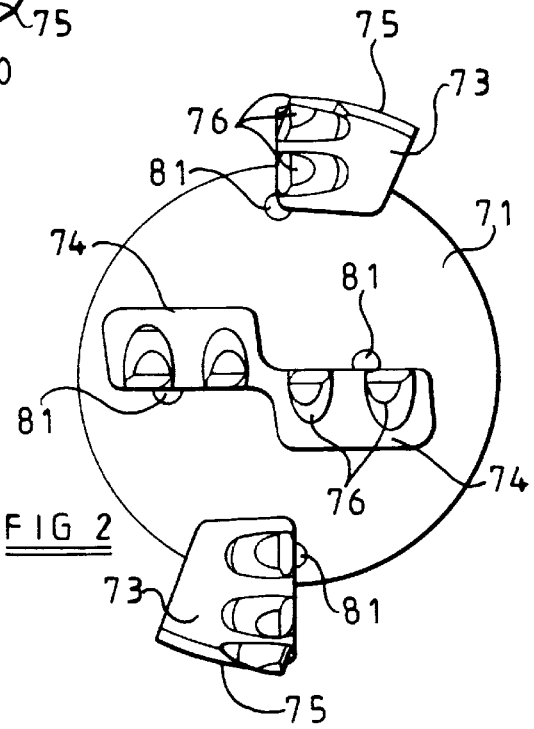
FIG. 2 is an end view of the drill bit of FIG. 1.
Figure 3:
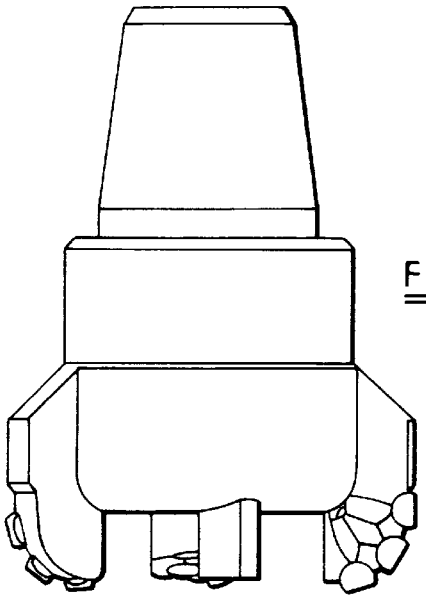
FIG. 3 is a side view of the drill bit of FIG. 1.

Although the arrangement shows a separate groove 82 for each cutter, arrangements are possible where a groove may serve two or more closely adjacent cutters, although the described arrangement is preferred. Although the cutter arrangement shown in FIGS. 1–3 is preferred, the number and type of cutter on each blade may be varied.

Figure 5:
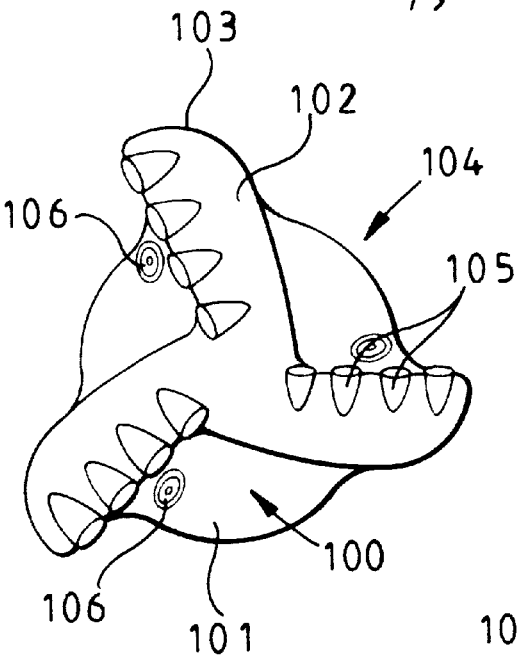
FIG. 5 is a diagrammatic end view of a form of drag-type drill bit which does not incorporate the invention.

FIG. 5 is a diagrammatic end view of a form of drag-type drill bit which does not incorporate the invention. The drill bit comprises a bit body 100 having an end face 101 on which are formed three upstanding blades 102 which are joined in the vicinity of the central axis of the bit and extend outwardly away from the central longitudinal axis to join, at the gauge region of the bit, with respective kickers 103 which are spaced apart around the gauge of the bit to define between them junk slots 104. Mounted on each blade are four spaced cutters 105, which may be preform cutters of the kind previously described. As in the previous arrangement the cutters 105 are arranged at different distances from the central axis of rotation of the drill bit so that, as the bit rotates, the cutters between them sweep over the whole of the bottom surface of the borehole so as to define a substantially continuous cutting profile.

There may be mounted in the leading surface 101 of the bit body a nozzle 106 for delivering fluid to the cutters on the associated blade. In order to direct fluid from each nozzle 106 to the associated cutters 105 the leading surface of each blade 102 may be formed with a group of grooves for directing fluid from a single nozzle to a plurality of cutters.

Figure 6:
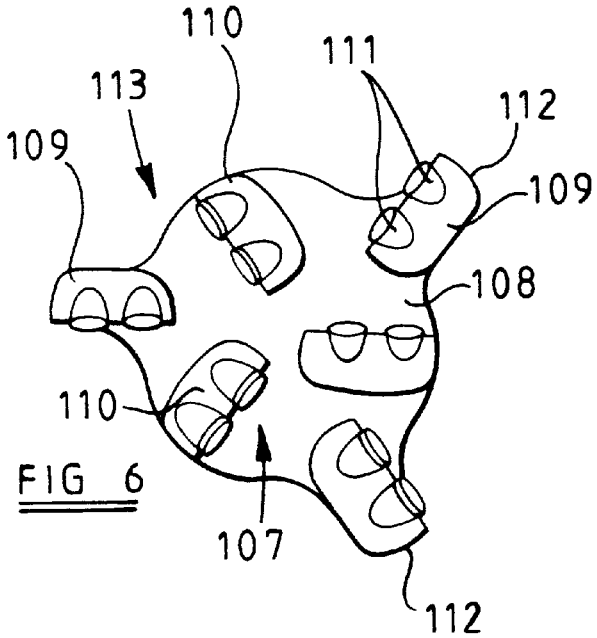
FIG. 6 is similar views to FIG. 2 of alternative forms of drill bit incorporating the invention.

FIG. 6 shows a modified and improved form of blade arrangement for a drag-type drill bit which provides the advantages of the arrangement of FIG. 5 while reducing or eliminating the disadvantages of such a bit, as previously described.

In accordance with the present invention the leading face 108 of the bit body 107 in FIG. 6 is formed with six upstanding blades comprising three primary blades 109 circumferentially spaced between which are three secondary blades 110, each of which is associated with a particular primary blade. Each blade carries two cutters 111 and a nozzle (not shown) is associated with each blade to direct drilling fluid to the two cutters on the blade using an arrangement of grooves in the leading surface of the blade to direct the fluid to the cutters, as in the previously described arrangements.

The primary blades 109 join with kickers 112 which engage the walls of the borehole and are spaced apart around the gauge section of the bit to define between them junk slots 113 through which drilling fluid is delivered to the annulus between the drill string and the walls of the borehole. Each primary blade 109 extends only a short distance inwardly from its associated kicker towards the central axis of the drill bit.

In the drill bit shown in FIG. 6 each secondary blade 110 is associated with that primary blade which is disposed rearwardly of it with respect to the normal direction of rotation of the drill bit. Other arrangements are possible, however, and the primary blade could be disposed forwardly of its associated secondary blade or, indeed, in any other relative circumferential position on the face of the drill bit.

Each secondary blade is in a radial position which overlaps the radial position of its associated primary blade, and each cutter on the secondary blade is disposed nearer the axis of rotation of the bit than the corresponding cutter on the associated primary blade. Each secondary blade terminates at the outer periphery of the bit body 107 and inwardly of the outer formation-engaging surfaces of the kickers 112.

Thus, each primary blade 109, in combination with its associated secondary blade 110, is equivalent, as far as its contribution to the cutting profile is concerned, to one of the blades 102 of the arrangement of FIG. 5. However, the drill bit of FIG. 6 is in other respects a six-bladed bit giving advantages in stability and lack of vibration. Also, since the secondary blades are displaced both circumferentially and radially with respect to their associated primary blades, drilling fluid can more easily flow over and between the blades in the circumferential direction, thus enhancing the cleaning and cooling of the cutters. In the arrangement of FIG. 5, cuttings swept from each of the blades 102 will tend to pass through the same region of the associated junk slot 104. However, in the arrangement of FIG. 6, since the primary and secondary blades are circumferentially spaced, the cuttings swept from those blades will pass through different regions of the associated junk slot 113 again enhancing the removal of cuttings from the bit.

Similar remarks apply to the blade arrangement of the drill bit shown in FIGS. 1–3 where the outer blades 73 are primary blades and the inner blades 74 are secondary blades, so that the four-bladed bit is in some respects equivalent to a two-bladed bit where each blade extends continuously from a kicker 75 inwardly towards the central axis of rotation of the bit.

Whereas the present invention has been described in particular relation to the drawings attached hereto, it should be understood that other and further modifications, apart from those shown or suggested herein, may be made within the scope and spirit of the present invention.

What is claimed:

1. A drag-type drill bit for drilling holes in subsurface formations comprising a bit body having an end face and a shank for connection to a drill string, a plurality of blades upstanding from the end face of the bit body and extending radially outwardly away, a plurality of cutting elements mounted on each blade, and a plurality of nozzles in the bit body for delivering drilling fluid to the end face thereof for cooling and cleaning the cutters, said blades including a plurality of primary blades which, at their outer ends, are spaced apart around a peripheral gauge portion of the bit, and a plurality of secondary blades spaced circumferentially between the adjacent primary blades, each secondary blade having an outer end which terminates at a location adjacent to the outer periphery of the bit body and inwardly of the gauge portion of the bit.

2. The drill bit according to claim 1, wherein the outer ends of the primary blades join respective kickers which, in use, engage the surrounding wall of the borehole being drilled.

3. The drill bit according to claim 2, wherein junk slots are defined between the kickers, the drilling fluid flows from the end face of the bit through the junk slots.

4. The drill bit according to claim 1, wherein the outer end of each secondary blade terminates at the outer periphery of the end face of the bit body.

5. The drill bit according to claim 1, wherein a number of the secondary blades equals a number of the primary blades, the secondary blades alternating with the primary blades around the central axis of rotation of the bit body.

6. The drill bit according to claim 1, wherein the cutters on the blades are located at different distances from the central axis of rotation of the bit body so as to define a substantially continuous cutting profile which extends over substantially the whole of the bottom surface of the borehole being drilled.

7. The drill bit according to claim 1, wherein each cutting element is a preform cutting element comprising a front facing table of superhard material bonded to a less hard substrate.

8. The drill bit according to claim 7, wherein the cutting element is substantially cylindrical, the substrate received and secured within a cylindrical socket in the bit body.

9. The drill bit according to claim 7, wherein each cutting element is of generally circular cross-section.

10. The drill bit according to claim 7, wherein each cutting element has a front surface on the facing table and a substantially straight cutting edge formed by a substantially flat bevel in the facing table and substrate which is inclined to the front surface of the facing table.

* * * * *